US006283418B1

(12) United States Patent
Kerspilo, Jr. et al.

(10) Patent No.: US 6,283,418 B1
(45) Date of Patent: Sep. 4, 2001

(54) GOLF BAG SUPPORT DEVICE

(76) Inventors: Raymond J. Kerspilo, Jr., 5256 Lin Hill Dr.; Richard D. Bell, 5025 Wyndemere Sq., both of Swartz Creek, MI (US) 48473

( * ) Notice: Subject to any disclaimer, the term of this patent is extended or adjusted under 35 U.S.C. 154(b) by 0 days.

(21) Appl. No.: 09/040,053

(22) Filed: Mar. 17, 1998

Related U.S. Application Data

(60) Provisional application No. 60/040,855, filed on Mar. 17, 1997.

(51) Int. Cl.[7] ..... A63B 55/00

(52) U.S. Cl. ..... 248/96; 206/315.7; 248/310

(58) Field of Search ..... 248/96, 309.1, 248/310; 280/47.26, DIG. 6; 224/274; 211/20.2, 205, 37; 206/315.7, 315.6

(56) References Cited

U.S. PATENT DOCUMENTS

| | | | | |
|---|---|---|---|---|
| D. 150,572 | * | 8/1948 | Hutsell | 280/13 |
| 1,475,605 | * | 11/1923 | Smith | 248/96 |
| 1,683,169 | * | 9/1928 | Noya | 248/96 |
| 1,804,069 | * | 5/1931 | Stover | 211/85.3 |
| 1,924,182 | * | 8/1933 | Fritz | 248/96 |
| 2,453,565 | * | 11/1948 | Barden | 248/96 |
| 2,846,170 | * | 8/1958 | Huber | 248/96 |
| 2,902,238 | * | 9/1959 | Tolman | 248/96 |
| 3,870,153 | * | 3/1975 | Allsop et al. | 211/37 |
| 3,884,439 | | 5/1975 | Jeninga . | |
| 4,192,424 | * | 3/1980 | Allsop | 211/37 |
| 4,319,616 | * | 3/1982 | Light | 150/1.5 C |
| 4,355,746 | | 10/1982 | Casady . | |
| 5,074,571 | * | 12/1991 | Reese | 280/47.19 |
| 5,087,003 | | 2/1992 | Montgomery . | |
| 5,088,635 | | 2/1992 | Taylor et al. . | |
| 5,551,579 | | 9/1996 | Converse . | |
| 5,556,064 | * | 9/1996 | Cowe | 248/172 |
| 5,568,872 | * | 10/1996 | Hinnant, Sr. | 211/13 |
| 5,667,239 | * | 9/1997 | Yang | 248/96 |
| 5,848,716 | * | 12/1998 | Waranius | 211/189 |

* cited by examiner

*Primary Examiner*—Ramon O. Ramirez
*Assistant Examiner*—Korie H. Chan
(74) *Attorney, Agent, or Firm*—Plunkett & Cooney PC; Arnold S. Weintraub

(57) ABSTRACT

A support device for storing a golf bag and shoes. The support device includes an upper bracket body, a middle bracket body, and a lower bracket body. The upper bracket body includes a rest plate on which a top portion of a golf bag may rest. The middle bracket body includes an elongated stem which mounts against a vertical support. The lower bracket body has a disc plate upon which the bottom of a golf bag may be seated, the disc plate having a bottom surface. In addition, the support device may include a shoe support disposed across the elongated stem or integrated into the lower bracket body or a shoe compartment provided below.

16 Claims, 10 Drawing Sheets

FIG 1
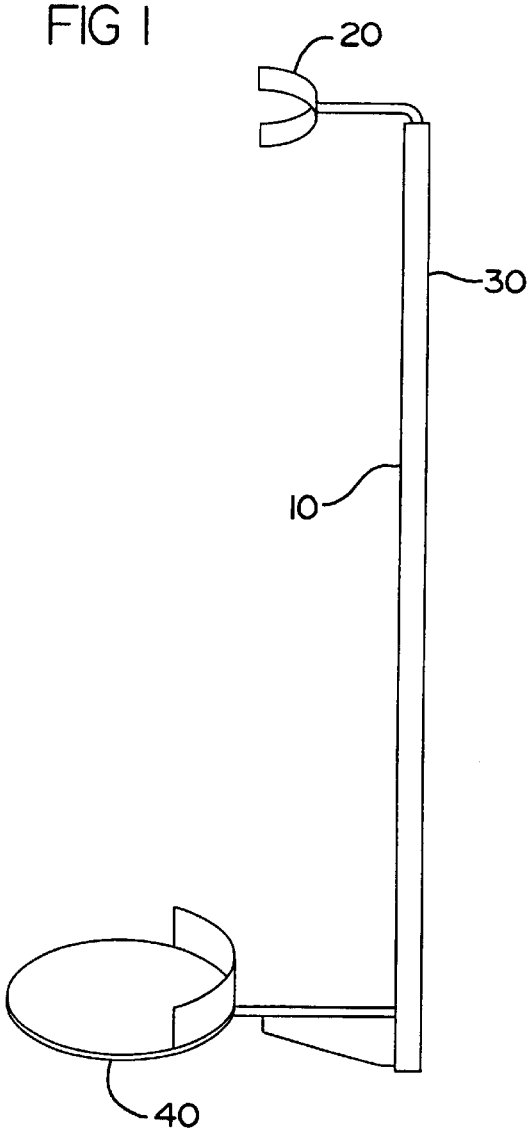
FIG 3
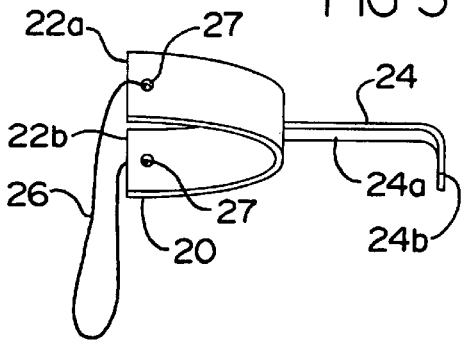
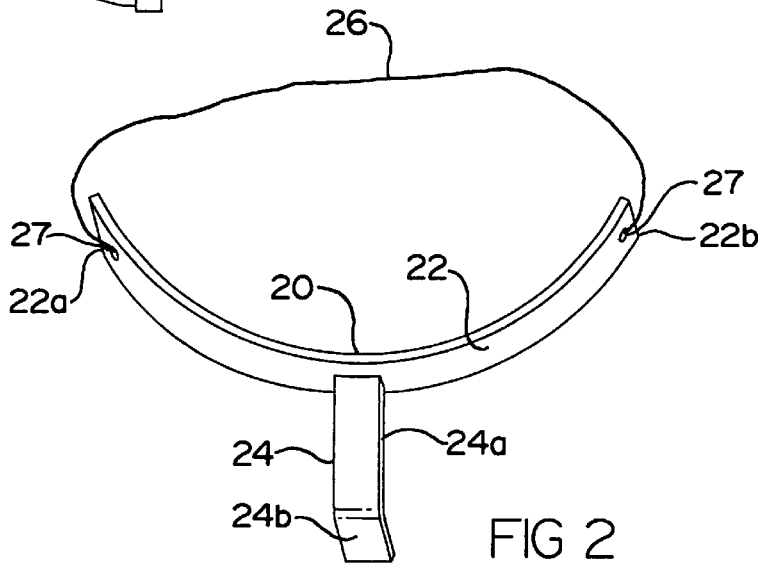
FIG 2

FIG 4
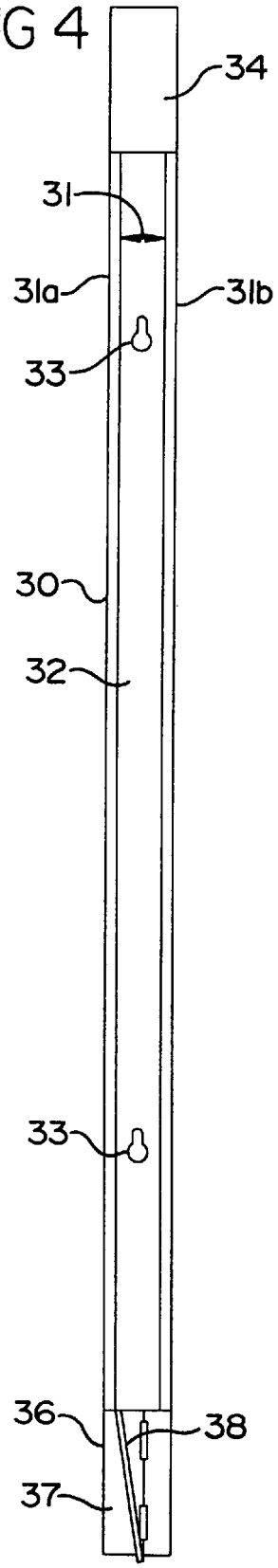
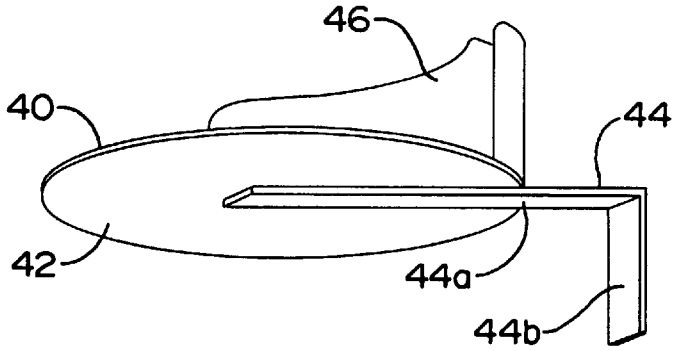
FIG 5

FIG 6
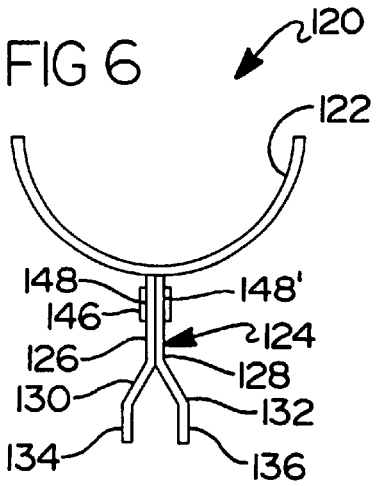
FIG 7
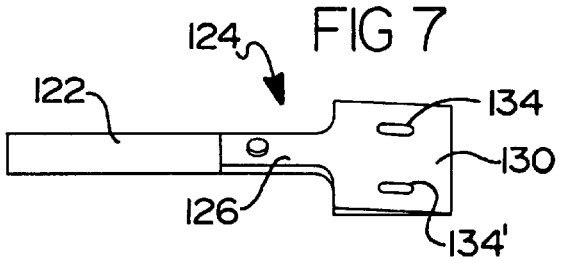
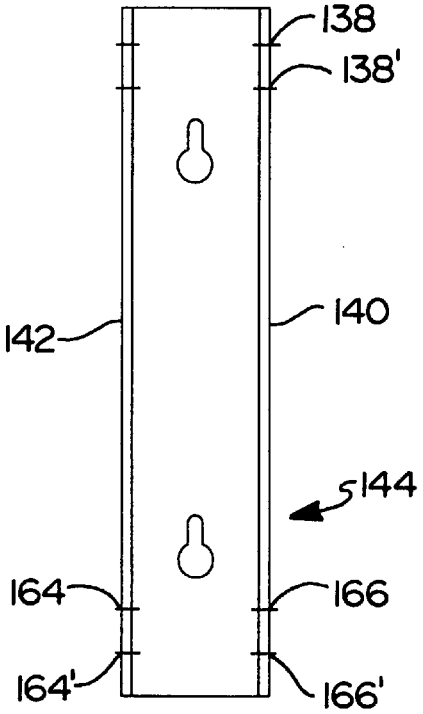
FIG 8
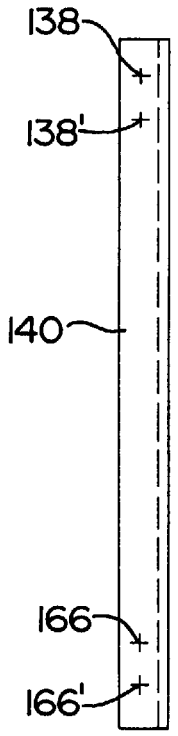
FIG 9

FIG 10
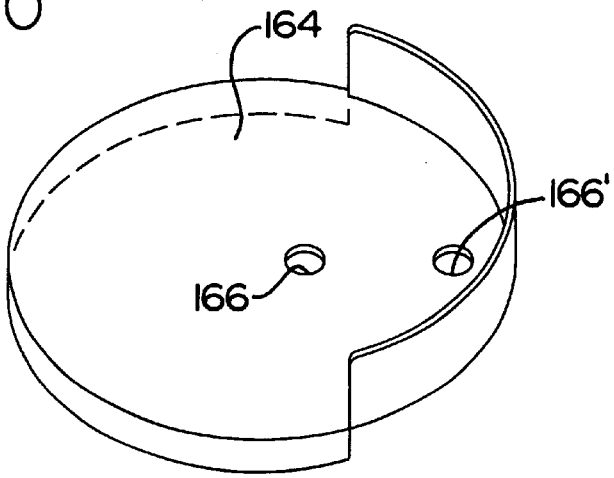
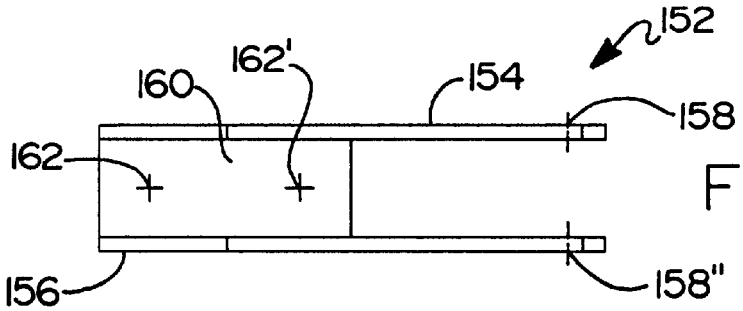
FIG 11
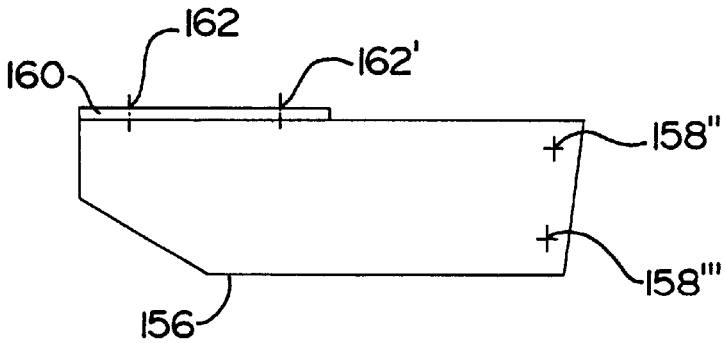
FIG 12

FIG 13
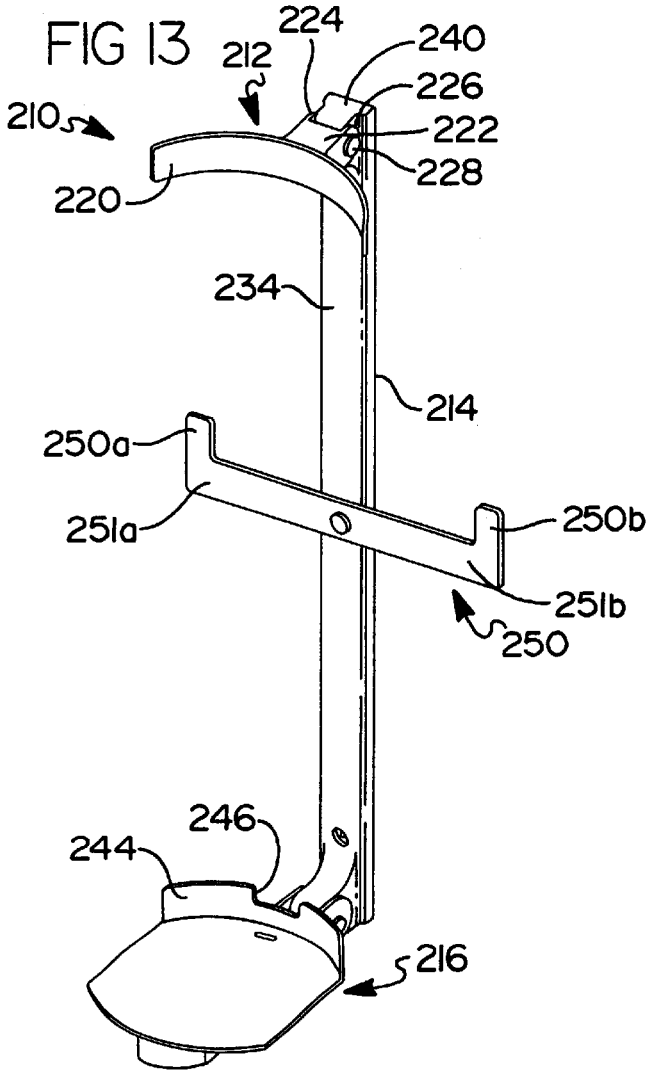
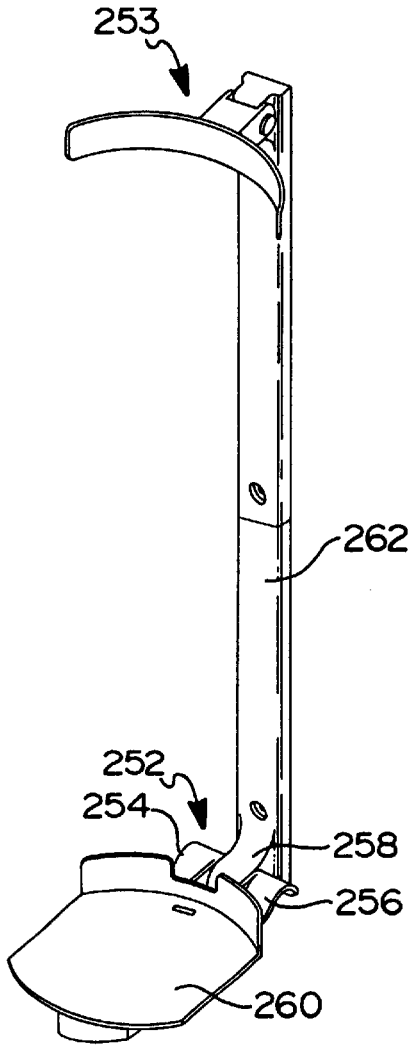
FIG 18

FIG 14
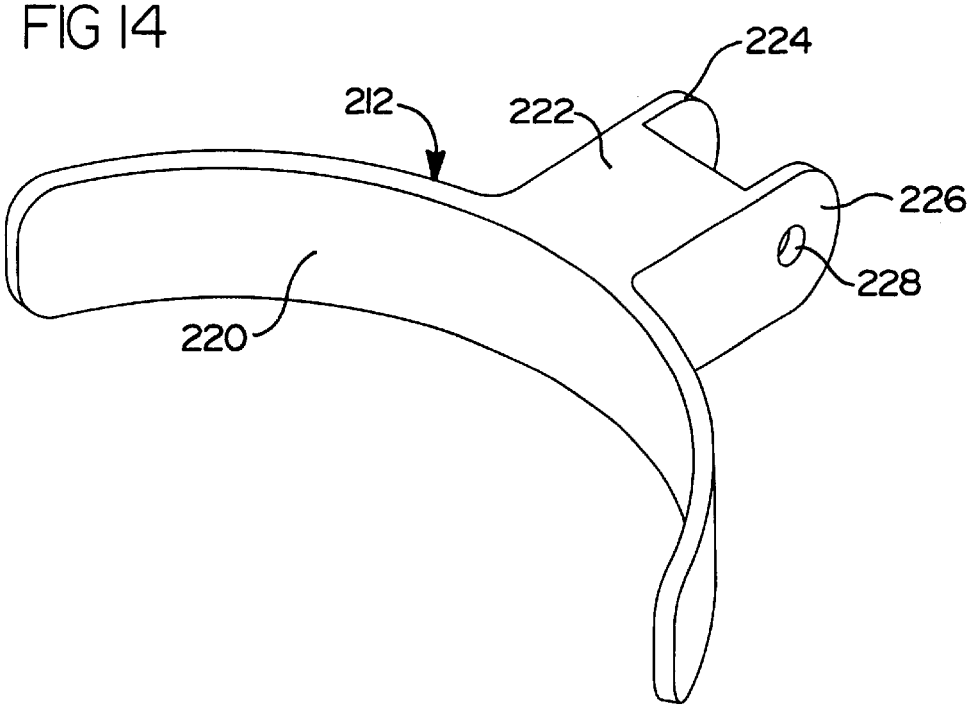
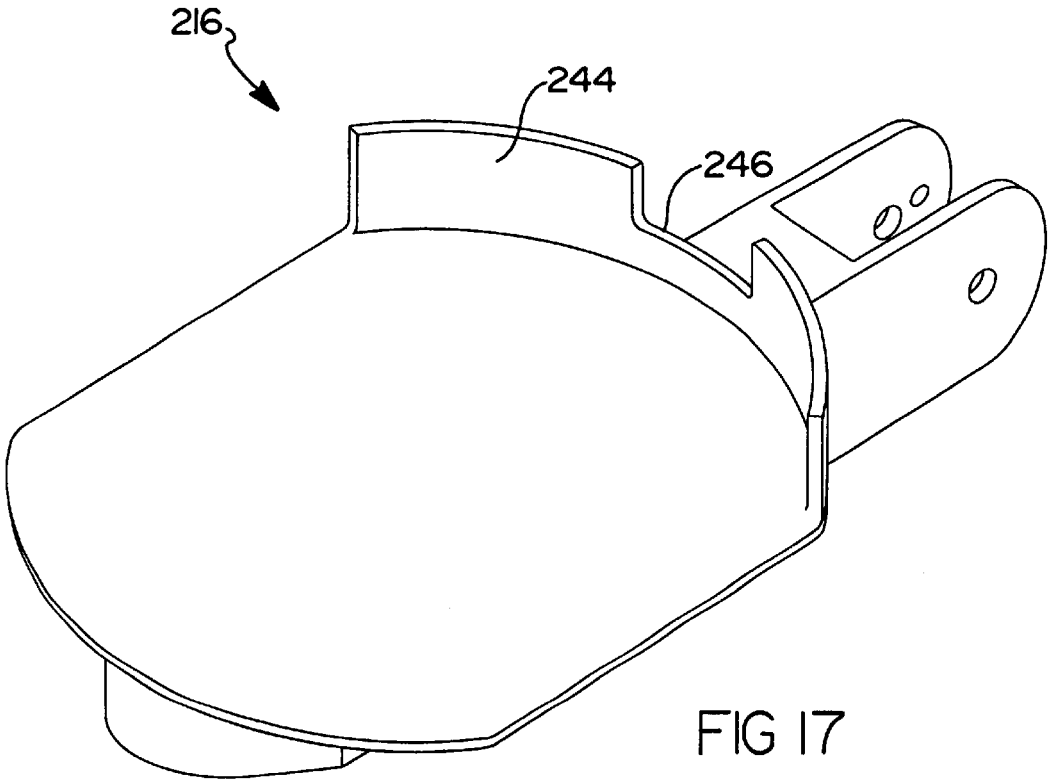
FIG 17

FIG 15
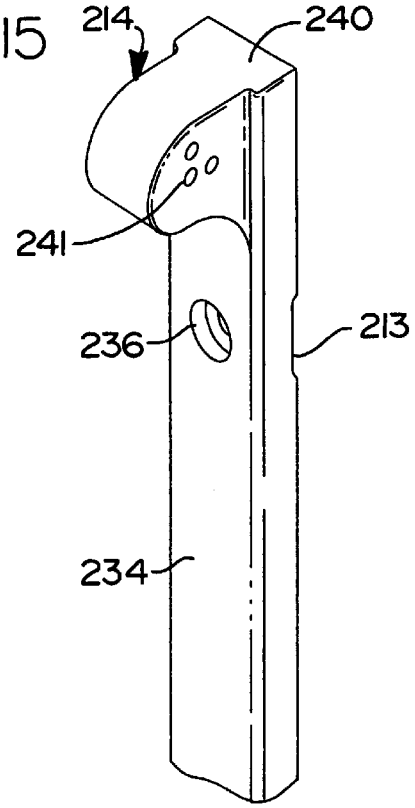
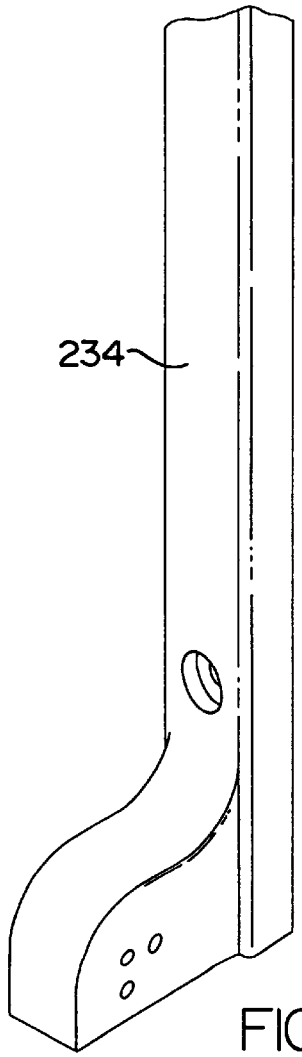
FIG 16

FIG 20
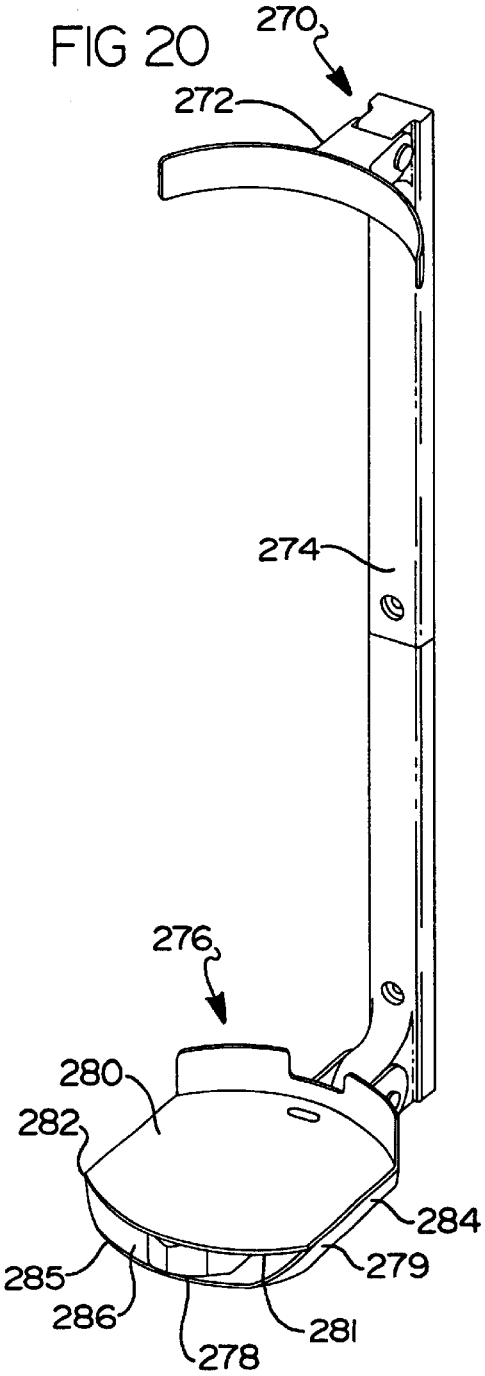
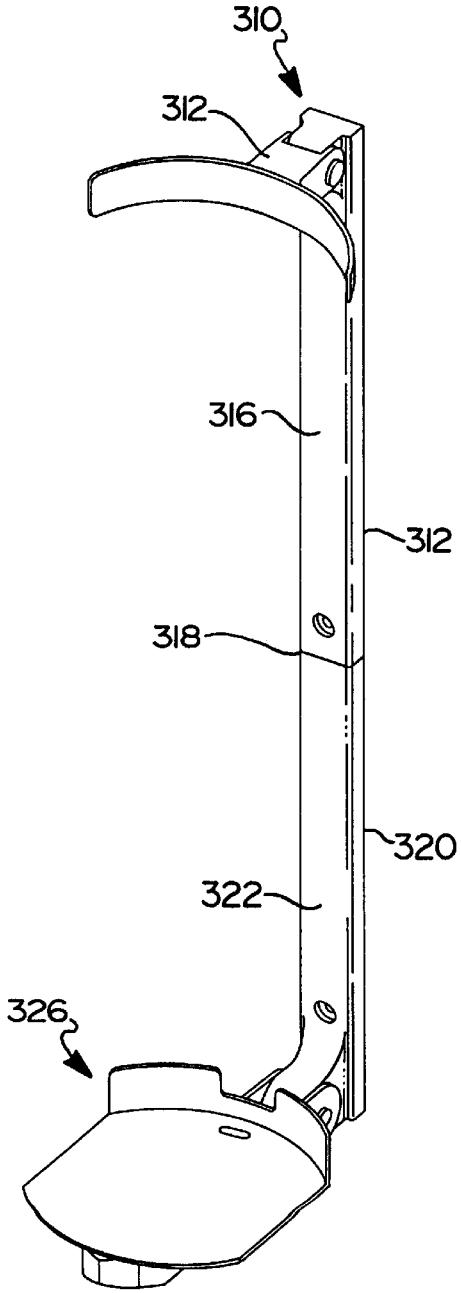
FIG 21

GOLF BAG SUPPORT DEVICE

CROSS-REFERENCE TO RELATED APPLICATIONS

This application is a completion application of a co-pending U.S. Provisional Patent Application filed Mar. 17, 1997, Ser. No. 60/040,855 the disclosure of which is hereby incorporated by reference.

STATEMENT REGARDING FEDERALLY SPONSORED RESEARCH OR DEVELOPMENT

Not Applicable.

BACKGROUND OF THE INVENTION

1. Field of the Invention

The present invention relates to a support for storing a golf bag. More particularly, the present invention concerns a wall mounted support device or a bracket for storing golf bags above the ground, which comprises a plurality of connecting members. Even more particularly, the present invention concerns a plurality of separable connecting members which cooperate to define a wall mounted support device for storing golf bags above the ground.

2. Prior Art

As is known to those skilled in the art, typically, a golf bag, when stored, is disposed at an incline, by leaning it against a wall, while seated on the floor. This practice leads to potential problems associated with damaging the bag and the contents therein. Such problems include the bag being inadvertently tipped onto the floor, mildew accumulating in and around the bag from floor dampness, etc. Thus, while the market for golf bags, themselves, has increased, heretofore, there has not been a convenient mode for storing a golf bag above the ground, lessening the likelihood of damage to the bag. What is needed is such a device for storing a golf bag. The present invention provides a device that fills this void.

Typifying the prior art devices which suffer from the noted deficiencies is, for example:

U.S. Pat. No. 5,551,579, issued Sep. 3, 1996 to Converse, entitled "WALL MOUNTED GOLF EQUIPMENT STORAGE CADDY." The patent teaches a wall mounted golf equipment storage caddy secured in place by a Velcro adhesive fastener which is attached to the top portion of the main support member. The base of the golf bag is stored inside a cup-like member that extends from the lower portion of the main support member. A shoe storage compartment is also disclosed therein, the compartment allowing storage of a pair of golf shoes below the cup-like member.

U.S. Pat. No. 3,884,439, issued May 20, 1975 to Jeninga, entitled "GOLF BAG CRADLE-BRACKET." The patent teaches an arcuate flexible cradle member made of hollow resilient material, the cradle member being suspended between and supported at its ends by two spaced side support bracket members. The assembly is dimensioned and shaped to receive a golf bag and provide support thereto, reducing wear of the bag at its engaging surfaces.

U.S. Pat. No. 5,087,003, issued Feb. 11, 1992 to Montgomery, entitled "GOLF BAG STAND." The patent teaches a free-standing furniture-type stand suitable for home use for storing a golf bag, or the like, off the floor and in an upright position, allowing a simplified identification and withdrawal thereof. The stand has a backwards tilt which aids in balancing and supporting the bag thereon.

U.S. Pat. No. 4,355,746, issued Oct. 26, 1982 to Casady, entitled "GOLF BAG HOLDER FOR USE WITH GOLF CARS." The patent teaches a golf bag holder for use with golf cars which includes a frame having a plurality of arms pivotally mounted thereto. The holder is secured to a golf car such that a golf bag can be attached to each arm and be held in a position allowing the bottom of the bag to rest in or on the car.

U.S. Pat. No. 5,088,635, issued Feb. 18, 1992 to Taylor et al., entitled "GOLF BAG RACK." The patent teaches a rack for holding golf bags, where the golf bags can be mounted on the upper surface of each rear fender of a conventional motor-driven golf cart. The rack includes a mounting base secured to the cart fender and a bag support member joined to the mounting base at an angle that allows the golf bag to be held at an optimum club-dispensing position. Moreover, a pair of substantially semicircular clips is provided at the terminal ends of the mounting base and support element to receive and secure a golf bag.

The present invention, as detailed below, provides a supporting and fastening device for golf bags containing a full complement of clubs, along with other accoutrements, such as umbrellas, balls, etc. More particularly, the present invention, as detailed below, provides a means for supporting a golf bag or similar device above the ground via a wall mounted bracket.

BRIEF SUMMARY OF THE INVENTION

In accordance herewith there is provided a golf bag support device which, generally, comprises:

(a) an upper bracket body;

(b) a middle bracket body connected to the upper bracket body; and (c) a lower bracket body connected to the middle bracket body.

The upper bracket body provides a resting support to and secures the top portion of a golf bag to the middle bracket. The upper bracket body, generally, includes a rest plate which engages the outer boundaries of a golf bag, a connecting arm which extends from the rest plate and interconnects the upper bracket body to the middle bracket body, and, preferably, a fastening band for further securing the golf bag thereon. The rest plate engages with the lateral boundaries of a golf bag or the like. The rest plate extends outwardly from the middle bracket or middle bracket body a first distance.

In a first embodiment, the middle bracket body is used to attach the present invention to a vertical surface, such as a wall, where desired. The middle bracket body, generally, comprises an elongated stem which attaches to a support surface, a track enclosure for detachably mounting the upper bracket body to the middle bracket body, and a support beam to support the lower bracket body. Alternate means may be used for securing the upper bracket body to the middle bracket or middle bracket body. The elongated stem abuts against a support surface. A plurality of apertures are formed through the elongated stem to enable a fastener to project therethrough for mounting the middle bracket body to a support surface.

The lower bracket or lower bracket body is attached to the middle bracket body and provides support to a golf bag by abutting against the bottom thereof. The lower bracket body, generally, comprises a disc plate which supports the bottom of a golf bag, and a support arm which extends from the disc plate and interconnects the lower bracket body to the middle bracket body. The disc plate has a catch member disposed thereon to prevent disengagement of the golf bag therefrom. The disc plate extends outwardly from the middle bracket a second distance, which is greater than the first distance such that a golf bag tilts angularly when disposed thereon and the upper portion of the bag rests against the rest plate.

The support hereof may, also, include a shoe storage assembly. The present invention enables above-ground storage of both a golf bag and shoes, lessening the potential of damage of the bag and the contents therein as well as the shoes.

For a more complete understanding of the present invention, reference is made to the following detailed description and accompanying drawing. In the drawing, like reference characters refer to like parts throughout the several views in which:

BRIEF DESCRIPTION OF THE SEVERAL VIEWS OF THE DRAWING

FIG. 1 is a perspective view of a first embodiment of a golf bag support device in accordance with present invention.

FIG. 2 is a broken perspective view of a first embodiment of an upper bracket body;

FIG. 3 an alternate perspective view of the upper bracket body FIG. 1 as seen from the side thereof;

FIG. 4 is a front view of a middle bracket body, of the golf bag support device of FIG. 1;

FIG. 5 is a side elevational view of a lower bracket body of the golf bag support device of FIG. 1;

FIG. 6 is a top plan view of an alternate embodiment of an upper bracket body of a second embodiment of a golf bag support device in accordance with this invention;

FIG. 7 a slide elevational view of the upper bracket body of FIG. 6;

FIG. 8 is a front elevational view of an alternate embodiment of a middle bracket body hereof, FIG. 9 is a side elevational view of the middle bracket body of FIG. 8;

FIG. 10 is a perspective view of an alternate embodiment of a lower bracket body disc plate;

FIG. 11 is a top plan view of a support arm of the lower bracket body of FIG. 8;

FIG. 12 is a side view of the support arm of FIG. 11;

FIG. 13 is perspective view of a further embodiment of a golf bag support device in accordance with this invention;

FIG. 14 a perspective view of the upper bracket body of the embodiment of FIG. 13;

FIG. 15 is a perspective view of a top portion of the middle bracket body of the embodiment of FIG. 13;

FIG. 16 is a perspective view of a bottom portion of the middle bracket body of the embodiment of FIG. 13;

FIG. 17 is a perspective view of the lower bracket body of the embodiment FIG. 13;

FIG. 18 is a pespective view of a further of a golf bag support device in accordance with the present invention;

FIG. 20 is a perspective view of another embodiment of the embodiment of FIG. 18, but showing a disc plate of the lower bracket body;

FIG. 21 is a perspective view of yet another embodiment of a golf bag support device in accordance with the present invention;

DETAILED DESCRIPTION OF THE INVENTION

Figure 19:
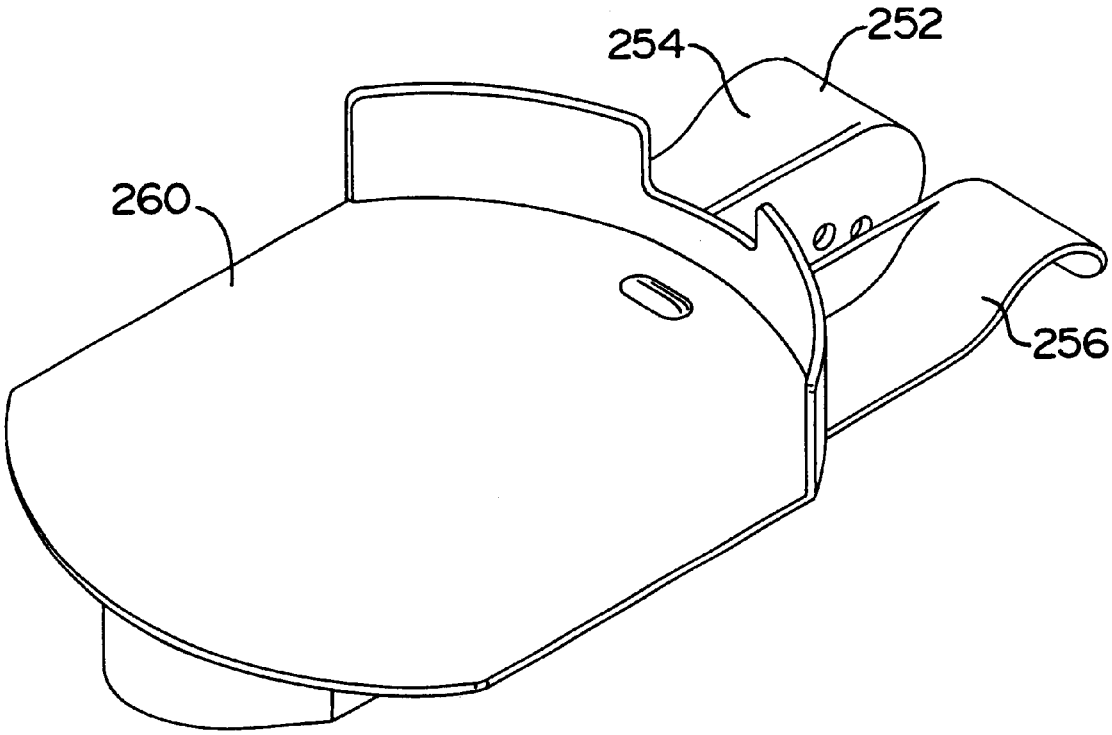
FIG. 19 is a perspective view of the lower bracket body of the golf bag support device of FIG. 18, which includes a shoe hanger.

With more particularity and with reference to the drawings, and in particular to FIGS. 1–5, in a first embodiment of the invention, the present invention provides a wall mounted support device or a bracket for supporting a golf bag or the like, generally denoted at 10, which generally comprises:

(a) an upper bracket body 20

(b) a middle bracket body 30 connected thereto; and (c) a lower bracket body 40 connected to the middle bracket body 30. The present bracket 10 particularly adapts to be mounted onto a support surface, preferably a wall.

As shown, the upper bracket body 20 provides a resting support to and secures the top portion of a golf bag (not shown) to the middle bracket body 30.

The upper bracket body 20 includes:

(i) a rest plate 22 which engages a portion of a golf bag;

(ii) a connecting arm 24 which extends from the rest plate 22 and interconnects the upper bracket body 20 to the middle bracket body 30; and (iii) a fastening band 26 which encircles a golf bag and which is provided on the rest plate 22.

The rest plate 22 is a slab-like arcuate member having a first end 22*a* and a second end 22*b*. The degree or radius of curvature of the rest plate 22 is of such extent as to allow a substantially greater arc than the radius of the top portion of a golf bag to enable the top of the bag to abut and rest thereagainst.

The rest plate 22 cooperates with the lower bracket body 40 to enable a golf bag to rest within the concave portion of the plate 22, with the golf bag being angularly inclined.

The opposed terminal or ends 22*a* and 22*b* of the rest plate 22 each have an opening 27, 27' formed therethrough. The terminal receive the ends of the fastening band 26 or other strapping for retaining a golf bag in position.

The connecting arm 24 is attached to the rest plate 22 and extends outwardly therefrom. The connecting arm 24 is, preferably, attached equidistantly to the rest plate 22 between the first end 22*a* and the second end 22*b* of the rest plate 22. The connecting arm 24 is an elongated planar "L-shaped" member having a first leg 24*a* and second leg 24*b* which are angularly disposed, preferably, at an obtuse angle, with respect to each other. The first leg 24*a* is secured to the rest plate 22 by any suitable means, such as by welding or the like or may be angularly formed therewith. The second leg 24*b* of the "L-shaped" member slidably and insertingly interconnects to the middle bracket body 30, as described below. Thus, with an obtuse angle afforded the legs of the connecting arm 24, a slight inward tilt is created upon the upper bracket body 20 toward a wall or vertical support.

The fastening band 26 is made of any suitable material such as a knitted cloth, preferably, elastically bound. The fastening band 26 connects to the rest plate 22 securing the golf bag onto the bracket 10. More specifically, each end of the fastening band 26 attaches, respectively, to the first end 22*a* and second end 22*b* of the rest plate 22 by any suitable means, such as by tying, strapping, hooking or the like. The parameters constituting the fastening band 26 is of the dimensions such that the length of the fastening band 26, when connected to the rest plate 22, may entirely enclose or encircle the top portion of a golf bag in order to securely fasten the bag. Moreover, such fastening is preferably conducted without applying an excessive amount of pressure onto the bag, allowing reduced wear thereon.

Alternatively, the fastening band 26 may comprise an adjustable strap which threads through the openings 27 and 27' and which surrounds the top of the bag.

The middle bracket body or middle bracket 30 is shown in FIG. 4 and is used to attach the bracket 10, of the present invention to a vertical support surface, such as a wall. Thus, the middle bracket body 30 has both the upper bracket body 20 and the lower bracket body 40, preferably, detachably connected thereto. The middle bracket body 30, generally, comprises:

(i) an elongated stem 32 which attaches to a support surface;

(ii) a track enclosure 34 for detachably mounting the connecting arm 24 to the middle bracket body 30; and (iii) a support beam 36 to support the lower bracket body 40.

The elongated stem 32 is a substantially u-shaped member 31 having a first facing planar surface 31*c* and first and second opposed sides or flanges 31*a* and 31*b*, the opposed sides being substantially parallel. The stem 32, also, includes the first and second opposite ends where the upper bracket body 20 and the lower bracket body 40, respectively, connect to the stem. The elongated stem 32 has a length, preferably, greater than the height of an angularly inclined average-sized, traditional golf bag; however, other lengths can be used. The opposed flanges 31*a*, 31*b*, are formed at the lateral edges of the stem and project therefrom. The flanges 31*a* and 31*b* cooperate with the facing surface 31 to provide a symmetrical track that runs vertically along the length of the stem 32. The track creates an open u-shaped slot with a slightly greater width 31 and thickness than both the connecting arm 24 of the upper bracket body 20 and a catch member 46 of the lower bracket body 40 to enable the connecting arm 24 and a support arm 44 to be inserted thereinto.

In use, the elongated stem 32 abuts against a support, surface such as a vertical w and the flanges 31*a* and 31*b* extend upwardly therefrom. A plurality of openings 33 are formed through the abuttable wall member 31 of the elongated stem 32 to enable a fastener, such as a toggle bolt, to project therethrough, mourning the middle bracket body 30 to a wall. With the open slot outward, the elongated stem 32 attaches to a support surface.

The present invention, as noted, includes a track enclosure 34. The track enclosure 34 is a planar, rectangular member or plate having a length substantially equal to the length of the second leg 24*b* of the "L-shaped" portion of the connecting arm 24. Moreover, the width of the track enclosure 34 is substantially equal to the width of the elongated stem 32. The track enclosure 34 is secured to the top of the elongated stem 32 to enclose the connecting arm 24 between the flanges, 31*a* and 31*b* thus, preventing disengagement therefrom. The track enclosure 34 attaches to the free ends of the flanges 31*a* and 31*b* by any suitable means, preferably by welding or the like.

The track enclosure 34 cooperates with the flanges 31*a* and 31*b* and facing surface 31*c* to create a slot into which the connecting arm 24 is inserted, detachably mounting the upper bracket body 20 to the middle bracket body 30.

The support beam 36 is attached to the bottom of the elongated stem 32 to provide support and secureness for the lower bracket body as described below. The support beam 36 includes a rectangular base 37, similar to that of the track enclosure 34, and a wedge plate 38, preferably, triangularly shaped.

The base 37 of the support beam 36 is a rectangular planar member, with a length substantially equal to the length of a second leg 44*b* of the support arm 44 of the lower bracket body 40 as detailed below. Moreover, the width of the base 37 is substantially greater than the width of the elongated stem 32. The base 37 is secured to the top of the elongated stem 32 to enclose the support arm 44. The base 37 attaches to the free ends of the flanges 31*a*, 31*b* by any suitable means, preferably by welding or the like, and cooperates therewith to define a slot akin to that described with respect to the track enclosure 34.

Additionally, the wedge plate 38 is secured to the base 37 by any suitable means, preferably by welding or the like, and projects outwardly therefrom. The wedge plate 38 defines a support for a first leg 44*a* of the support arm 44. More specifically, the wedge plate 38 connects to the base 37 such that, in practicing the present invention, the wedge plate 38 horizontally extends from the top of the base 37, providing substantial support to the lower bracket body 40.

In another aspect, second fastening band having first and second ends, similar to the fastening band 26 of the upper bracket body 20, may be attached to the middle bracket body 30 independent to or along with the fastening band 26. As such, the respective ends of the second fastening band may be attached to the elongated stem 32 of the middle bracket body 30 by any suitable means, as described hereinabove.

The lower bracket body 40 provides support to the bottom of a golf bag. The lower bracket body 40, as shown in FIG. 5, includes a plurality of interconnecting members, generally, comprising:

(i) a disc plate 42 to support the bottom of a golf bag, the disc plate including the catch member 46 disposed thereon to prevent disengagement of the golf bag from the lower bracket body and an aperture 47 provided therethrough to define a drain, (ii) the support arm 44 extending from the disc plate 42 and interconnecting the lower bracket body 40 to the middle bracket body 30.

The disc plate 42 is a plate of any suitable configuration, here shown as a planar circular mass. Although it may be simply an elongated arm or any other geometric pattern but, preferably, as a plate as shown. Preferably, although not necessarily, the diameter of the disc plate 42 is greater than the diameter of a golf bag.

The catch member 46 is attached to the disc plate 42 along a portion of the edge of the top of the plate 42 by any suitable means, such as by welding or the like. The catch member 46 is positioned proximate a supporting surface or wall when in use. The catch member 46 is an arcuate generally cylindrical wall circumferentially disposed on the disc plate 42. The radius of curvature of the catch member 46 is substantially equal to the radius of curvature of the respective portion of the disc plate 42. The catch member 46 is a rest for the lower end of a golf bag, and defines a stop for the golf bag to prevent it from sliding off the disc plate 42 if urged toward a wall.

An aperture 47 is provided through the disc plate 42 to define a drain for liquid and moisture. The aperture 47 may be provided at any suitable location and is formed through the disc plate 42. In use, the aperture 47 allows for drainage of liquid that accumulates on the disc plate 42, lessening the potential of damage to the golf bag stored thereon.

The support arm 44 is attached to the disc plate 42, and extends outwardly therefrom. The support arm 44 is attached to the disc plate 42 on the bottom side thereof, preferably, at the center thereof. The support arm 44 is an elongated, planar "L-shaped" member having the first and second legs 44*a* and 44*b*, which are obtusely angled with respect to each other and with the first leg 44*a* being longer than the second leg 44*b*. In length, the first leg 44*a* of the support arm 44 is longer than the first leg 24*a* of the connecting arm 24. The support arm 44 attaches to the disc plate 42 by any suitable means, preferably, by welding. Furthermore, the second leg 44*b* of the support arm 44 is inserted into the slot defined by the cooperation between the flanges 31*a*, 31*b* of the middle bracket body 30, by the base 37 of the support beam 36, and by the surface 31*c* of the stem 32. Thus, with the obtuse angle of the support arm 44, the support arm 44's obtuse angle, a slight inward tilt is created upon the lower bracket body 40 toward the wall.

As shown in FIGS. 1–5, the rest plate 22 extends outwardly from the top portion of the middle bracket body 30 a first distance and the disc plate 42 extends outwardly from the bottom portion of the middle bracket body 30 a second distance, where the second distance is greater than the first distance to enable a golf bag to be angularly inclined when stored with the present device.

Referring now to FIGS. 6 through 12, there is shown an alternate embodiment hereof. According to this embodiment, in lieu of the slotted interconnection between the components hereof, there is provided a mechanical fastening. Thus, and with specific reference to FIGS. 6 and 7 there is shown therein an upper bracket body or upper bracket 120 which, generally, comprises an arcuate portion or rest plate 122 and a connecting element 124. The connecting element 124 comprises a pair of arms 126, 128 which project laterally outwardly from a the rest plate 122 and which are in abutment. Each element arm 126 and 128 has an outwardly flared end portion 130, 132, respectively. Each of the flared end portions has an opening or aperture 134, 136 provided therein, which register with cooperable openings in the flanges 140 and 142 of the elongated stem 144 of the middle body bracket. Optimally, each flared end portion (only one of which is shown in FIG. 7) has a pair of vertically axially spaced apart openings. As shown in FIGS. 7–9, the flared end portion 130 includes the spaced openings 134 and 134' and the flared end portion 132 includes the spaced openings 136 and 136. The openings 134, 134' register with cooperable openings 138, 138' formed in the upper end of the flange 140 of the elongated stem 144. Similarly, the openings 136 and 136' register with the cooperable openings 139 and 139' formed in the upper end of the flange 142. By providing registration between the openings, a fastener such as a elongated threaded bolt or the like (not shown) can be projected through the registering and cooperable apertures to provide a mechanical fastening between the upper bracket body 120 and the elongated stem 144.

Similarly, at least one fastener 146 may project through the abutting arms to secure them together. Thus, each arm 126 and 128 is provided with an opening 148, 148' with the respective openings being adapted to be brought into register with one another. The fastener 146, such as a bolt or the like, projects through the openings 148 to 148' to secure the two arms 126 and 128 together.

In FIGS. 10–12, there is shown an alternate embodiment of the lower bracket body, generally, denoted at 150. Herein, a support bracket 152 comprises a pair of spaced apart arms 154, 156 each having a pair of vertically axially spaced part openings or apertures 158, 158', 158" and 158"'.

A top plate 160 spans between the two arms 154 and 156 and is secured thereto by any suitable means, such as by welding or the like. The top plate has a pair of apertures or openings 162, 162' formed therethrough.

A disc plate 165 is similarly constructed to the disc plate 42 of the first embodiment but has openings or apertures 163 and 163' formed therethrough which register with the apertures 162, 162', respectively, formed in the top plate 160. Thus, fasteners, such as bolts, screws or the like (not shown) can be inserted through the registering apertures and bolted together via a suitable bolt, nut or the like to, thus, mechanically fasten the disc plate 165 to the support bracket 152.

The lower end of the flanges 140, 142 are each provided with a pair of apertures 166 and 166', and 164 and 164' respectively, which register with the apertures, 158" and 158"', and 158 and 158'. Mechanical fasteners, such as elongated bolts or the like can then project through the registering apertures to, thus, mechanically secure the lower bracket body 150 to the elongated stem 144. The mechanical fastening, in lieu of the inserting arms, precludes any mental conception of inadvertent disassembly of the components.

Referring now to FIGS. 13 through 17, there is depicted therein a further embodiment of the present support device, generally, denoted at 210. As shown therein the support device 210 is a substantially integrally formed unit having an upper bracket body 212 (FIG. 14), a top portion 213 of a middle bracket body 214 (FIG. 15), a bottom portion 215 of the middle bracket body 214 (FIG. 16), and a lower bracket body 216 (FIG. 17).

The upper bracket body 212 includes an arcuate rest plate 220 and a pivot connecting arm 222 extending rearwardly therefrom. The pivot connecting arm 222 includes a pair of opposed flanges 224, 226 each having a registering aperture 228. A pivot pin or the like (not shown) projects through the openings 228 in the flanges 224 and 226 pivotally mount the upper bracket body 212 of the support device 210 to an elongate stem 234.

The middle bracket body 214 includes the elongated stem 234 having a top portion and a bottom portion. The elongated stem 234 is a substantially unitary body member having a plurality of apertures or openings 236 disposed longitudinally therealong for enabling the mounting of the stem to a support surface.

A mounting body 240 is disposed at the upper end of the stem 234 and projects laterally outwardly therefrom. The body 240 has a throughbore 241 formed therethrough. The body 240 has a diameter slightly less than that of the pivot connecting arm 222 of the upper bracket body 212 such that the terminus of the upper bracket body 212 nests between the flanges 224 and 226, as shown, and the bore 241 registers with the openings 228 of the flanges 224, 226 to enable a pivot pin (not shown) to project therethrough. In this manner, the upper bracket body 212 is pivotally mounted to the middle bracket body 214.

The lower bracket body 212 is similarly constructed to the upper body to enable the lower bracket body 276 to be pivotally nested when not in use against the middle bracket body 214. As shown, a catch member 244 of the lower bracket body 216 has a cut-out portion or slot 246 which enables the catch member 244 to be coincident with the sides of the elongated stem 234 when the lower bracket body 216 is pivotally rotated into engagement therewith. In this embodiment the bracket is formed as a unitary member, without separable components.

The present invention further incorporates therewithin, means for mounting and storing a pair of shoes thereon. In an embodiment herein, a T-bar or shoe support 250 or the like is secured to the elongated stem 234 through one of the apertures 236 thereof The T-bar 250 includes a cross member 251, preferably but not limited to, having a first end 251*a* and a second end 251*b*, a first wedge 250*a* extending upwardly from the first end 251*a* and angled outwardly from the elongated stem 234, and a second wedge 250*b* extending upwardly from the second end 251*b* and angled outwardly from the elongated stem 234. The wedges 250*a*, 250*b* of the tee bar 250 are, preferably, angled outwardly to allow for mounting a pair of shoes (not shown) thereon with sufficient space from an, otherwise, obstructing wall or vertical support.

In another embodiment of a golf bag support device in accordance with the present invention as depicted in FIGS. 18 and 19 as 253, there is provided a shoe hanger 252 having a first tongue 254 and a second tongue 256, spaced apart from the first tongue 254 and disposed proximate the middle bracket body and secured to the lower bracket body. The shoe hanger 252 is, preferably, secured laterally to a support arm 258.

Each of the tongues 254, 256 are laterally aligned with the support arm 258 such that the support arm 258 is aligned interstitially with the tongues 254, 256. However, the shoe hanger 252 may be secured to a disc plate 260 in any other fashion, i.e., proximate the elongated stem 262, lateral to the disc plate 260.

Referring to FIG. 20, there is depicted a support device, generally, denoted at 270. As shown therein and similar to the embodiments provided hereinabove, the support device 270 has an upper bracket body 272, a middle bracket body 274, and a lower bracket body 276. In this embodiment, the lower bracket body 276 includes a shoe compartment 278 extending below a disc plate 280. The shoe compartment 278 is defined by a walled member 279 having a first end 282, a second end 284, and a flooring 285. The first end 282 and the second end 284 are, preferably, respectively connected to opposing sides of the bottom surface 281 of the disc plate 280, defining the shoe compartment 278 in which shoes (not shown) may be stored where such shoes may rest on flooring 285. As such, an opening 286 which is positioned opposite the wall or vertical support receives the shoes for storing.

It is to be appreciated that in the embodiments there is provided a separable bracketry which has components that are easily assembled together to provide the separable bracketry. In one aspect, the present invention may be disassembled to provide three separable components, i.e., the upper bracket body, the middle bracket body, and the lower bracket body, as is described hereinabove.

Figure 22:
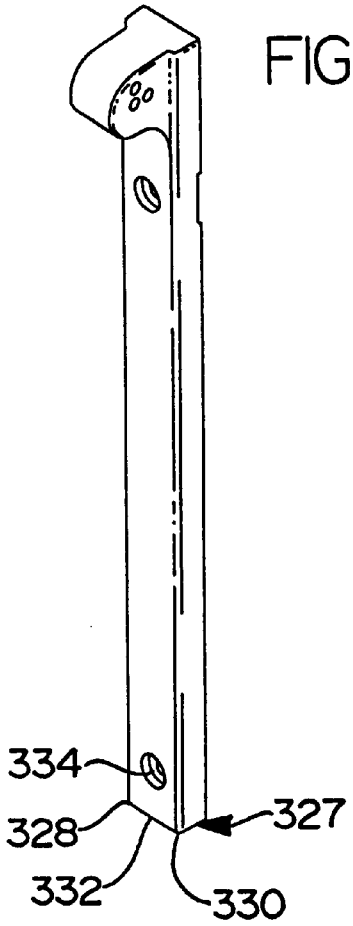
FIG. 22 is a perspective view of a top portion of an elongated stem of the middle bracket body of the golf bag support device of FIG. 21.
Figure 23:
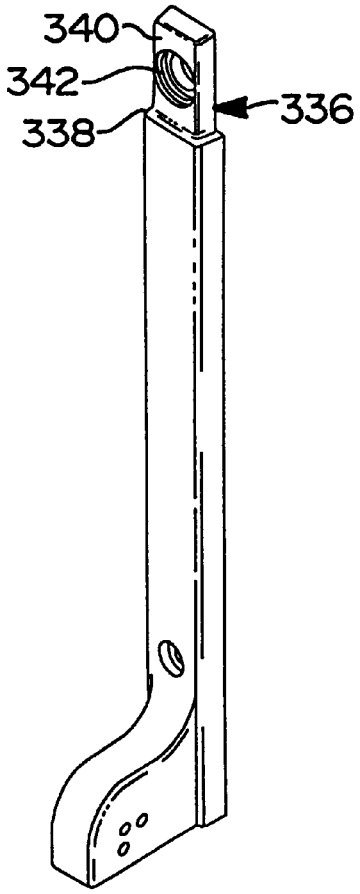
FIG. 23 is a perspective view of a bottom portion of an elongated stem of the middle bracket body of the golf bag support device of FIG. 21.

However, in another aspect hereof and as depicted in FIGS. 21–23, the present support device which is generally denoted at 310 may comprise two separable components. The two separable components include:

(a) a first member 312, the first member 312 comprising an upper bracket body 314 and a top portion 316 of a middle bracket body 318;

(b) a second member 320, the second member 320 comprising a bottom portion 322 of the middle bracket body 318 and a lower bracket body 326.

The first and second members 312, 320 are engaged by means for connecting the two members together. Preferably, the first member 312 includes a first end 327 having a first lateral arm 328, a second lateral arm 330, and a center opening 332 having an aperture 334 therethrough. The second member 320 includes a first end 336 having a lateral shoulder 338 and a center arm 340 having an aperture 342 therethrough. The center arm 340 telescopes into the center opening 332 with the apertures 334, 342 being in registry. A fastener (not shown) projects through the registering apertures 334, 342 to secure the two members 312, 320 together. The lateral arms 328, 330 rest on the shoulder 338.

As shown the lower bracket body support arm has a length greater than that of the upper bracket connecting arm to effectuate the angular inclination imparted to the container.

The present invention is made of strong durable material, preferably lightweight metal, such as aluminum or the like. Alternatively, the invention hereof maybe formed from a high density plastic, such as polyethylene, polypropylene, or the like. As such, the upper bracket body, the middle bracket body, and the lower bracket body may be each integrally formed.

In use, a golf bag is disposed on the disc plate of the lower bracket body, allowing angular inclination thereof Moreover, the top portion of a golf bag rests against the rest plate of the upper bracket body. The fastening band encircles the top of the golf bag, preventing disengagement from the bracket. Although described with reference to a golf bag, other elongated storage containers may be stored with the bracket hereof Furthermore, the present device need not be mounted onto a wall, but may be seated on the ground in abutment with a wall; may be used as a bag rack at a golf course; may be hooked onto a motorized carousel; may be mounted on a post or in similar environments which enable the upright stowing of the bag. In any event, the present invention enables above-ground storage. Likewise, where a unitary device is desired it is possible to weld the upper and lower bracket bodies to the stem or mold the bodies when formed of plastic.

Although, as described above, the use of the support device is suitable for storage of a golf bag and shoes, the support device may be used for storage and support of other items. Such items may include duffle bags, suitcases, garment bags, and any other suitable item.

Having, thus, described the invention, what is claimed is:

1. A wall mounted support device for a golf bag, the support device comprising:

(a) an upper bracket body, the upper bracket body comprising:

a C-shaped shaped rest plate, the rest plate having a first end and a second end and a contoured medial portion between the first and second ends and shaped to conform to the contour of the top portion of a golf bag; and a connecting arm extending outwardly from the medial portion of the rest plate;

(b) a lower bracket body, the lower bracket body comprising a substantially planar disc plate having a top surface and a bottom surface; and a support arm extending outwardly from the disc plate;

(c) a middle bracket body, the middle bracket body comprising:

an elongated stem having a top portion and a bottom portion;

means for detachably mounting said connecting arm to the top portion of the elongated stem ; and means for detachably mounting said support arm to the bottom portion of the elongated stem; and (d) means for mounting the elongated stem to a support wall;

the support arm and the connecting arm each mounted so as to extend generally horizontally outwardly and away from the middle bracket body with said disc plate being disposed further away from said middle bracket body than said rest plate; and wherein a golf bag bottom rests on the top surface of the disc plate and a top portion of the bag rests on the rest plate.

2. The support device of claim 1, which further comprises a fastening band for encicling the golf bag wherein the fastening band has a first end and a second end, the first end of the fastening band attaching to the first end of the rest plate and the second end of the fastening band attaching to the second end of the rest plate.

3. The support device of claim 1, wherein the lower bracket body further comprises a catch member circumferentially disposed on the top surface of the disc plate and proximate to the middle bracket body, the catch member being an arcuate member which defines a stop for the golf bag to prevent it from sliding off the disc plate if urged towards the wall.

4. The support device of claim 1, wherein the means for detachably mounting the top portion of the elongated stem to the connecting arm of the upper bracket body includes means for pivotally attaching the connecting arm to the elongated stem.

5. The support device of claim 1 which further comprises a shoe support, the shoe support, the shoe support comprising:

(a) a cross member, the cross member having a first end and a second end;

(b) a first wedge, the first wedge extending upwardly from the first end; and (c) a second wedge, the second wedge extending upwardly from the second end.

6. The support device of claim 5, wherein the shoe support is secured to the middle bracket body.

7. The support device of claim 1, wherein the lower bracket body further comprises a shoe hanger, the shoe hanger comprising a first tongue and a second tongue.

8. The support device of claim 1, wherein the lower bracket body further comprises a shoe compartment for storing shoes, the shoe compartment being disposed on the bottom surface of the disc plate and extending downwardly therebelow.

9. The support device of claim 8, wherein the shoe compartment includes a walled member having a first end, a second end, and a flooring, the first end and the second end respectively connecting to opposite sides of the bottom surface of the disc plate.

10. The support device of claim 1, wherein the lower bracket body has a drain aperture formed therethrough.

11. The support device of claim 1, wherein the support device comprises:

(a) a first member, the first member including the upper bracket body and the top portion of the middle bracket body;

(b) a second member, the second member including the bottom portion of the middle bracket body and the lower bracket body; and (c) means for connecting the second member to the first member.

12. A wall mounted support device for mounting a golf bag, said support device comprising:

a longitudinally elongated bracket adapted to be mounted generally vertically to a support wall, said bracket having a top end portion and a bottom end portion, a first bag support means, detachably connected to the bottom end portion of said bracket, for supporting and positioning the bottom end of a golf bag a first distance horizontally outwardly from said elongated bracket when the bracket is mounted to the support wall, said first bag support means comprising a substantially planar disc plate having a top surface and a bottom surface, and a support arm having a first end portion connected to said disc plate and a second end portion connected to the bottom end portion of said bracket, said first end portion positioning said disc plate to extend upwardly and outwardly at an acute angle to the support wall, a second bag support means, detachably connected to the top end portion of said bracket, for supporting and positioning the top end of a golf bag a second distance horizontally from said elongated bracket when the bracket is mounted to the support wall, said second bag support means comprising a C - shaped recess plate having a first end and a second end, and a connecting arm having a first end portion connected to the recess plate so that the "C" opens outwardly from the bracket to receive the golf bag and a second end portion detachably connected to the top end portion of said bracket, said second distance being less than said first distance, wherein said golf bag is supported and positioned in such manner that the golf bag is at an acute angle to the wall with the golf bag bottom resting on the top surface of the disc plate and the golf bag top resting against the contour of the C-shaped recess.

13. The wall mounted support device as claimed in claim 12, wherein said first bag support means further comprises an arcuate catch member connected to and extending upwardly from the top surface of said disc plate, said catch member being proximate to said bracket and opening outwardly from said bracket to receive and support the lower end portion of said golf bag, and a storage compartment for storing shoes, said compartment being connected to and extending downwardly from the bottom surface of said disc plate.

14. A wall mounted support device for a golf bag, the support device comprising:

a middle bracket body having an upper end portion and a lower end portion, an arcuate rest plate, a connecting arm having a first end portion connected to said rest plate and a second end portion, pivot means for pivotally connecting the second end portion of said connecting arm to the upper end portion of said middle bracket body, a disc plate having a top surface and a bottom surface, pivot means for pivotally connecting the disc plate to the lower end portion of said middle bracket body, and a catch member extending upwardly from the top surface of said disc plate and contoured to engage the contour of the golf bag, said catch member and said rest plate being adapted to pivot from an in use first position, disposed generally horizontally and perpendicular to said support wall, and to a not in use second position, disposed generally vertically and parallel to the support wall, wherein the golf bag bottom rests on the top surface of the disc plate and the rest plate supports the top portion of the bag.

15. The wall mounted support device as claimed in claim 14, wherein said catch member comprises a cylindrical wall extending upwardly from the top surface of said disc body, said cylindrical wall having a cut-out portion which enables the catch member to nest within the middle bracket body when the catch member is pivoted upwardly to the not is use position.

16. The wall mounted support device as claimed in claim 15, wherein said rest plate is generally C-shaped and said connecting arm positions the "C" to open outwardly from the support wall, said rest plate being contoured to conform to the contour of the top portion of the golf bag.

* * * * *